US006907675B1

(12) United States Patent
Hutchings

(10) Patent No.: US 6,907,675 B1
(45) Date of Patent: Jun. 21, 2005

(54) BOLT HOLE MARKER

(76) Inventor: Bob Hutchings, 806 Singing Drum Dr., Henderson, NV (US) 89015

( * ) Notice: Subject to any disclaimer, the term of this patent is extended or adjusted under 35 U.S.C. 154(b) by 0 days.

(21) Appl. No.: 10/442,818

(22) Filed: May 20, 2003

Related U.S. Application Data

(60) Provisional application No. 60/384,459, filed on May 31, 2002.

(51) Int. Cl.[7] ..... B25H 7/04

(52) U.S. Cl. ..... 33/666; 33/613; 33/669; 33/574

(58) Field of Search ..... 33/666, 669, 501.45, 33/501.5, 501.19, 613

(56) References Cited

U.S. PATENT DOCUMENTS 1,306,467 A * 6/1919 Coughtry ..... 33/669
3,808,690 A * 5/1974 Balder ..... 33/613
4,363,173 A * 12/1982 Caldera ..... 33/666
4,519,143 A * 5/1985 Correlli ..... 33/669
5,068,976 A * 12/1991 Bell ..... 33/666
5,375,339 A * 12/1994 Noel, Jr. ..... 33/518
6,508,011 B1 * 1/2003 Lee ..... 33/666

* cited by examiner

*Primary Examiner*—Christopher W. Fulton
*Assistant Examiner*—Yaritza Guadalupe
(74) *Attorney, Agent, or Firm*—Harry M. Weiss; Weiss, Moy & Harris, P.C.

(57) ABSTRACT

A marker for marking the location for drilling holes to pass the line of bolts in a plate to be secured to the slab of a building. The marker includes a rotatable gauge having a plurality of different sizes of notches each to nest a different diameter of bolt to locate the center of the bolt a predetermined distance from approximately the center of the plate. The user positions the marker against the bolt and atop the plate and imparts a force to cause a tip to impart a mark on the plate for the location for a hole to pass the bolt. The gauge may also be used to obtain the size of the bolt and hence the hole required to closely pass the bolt.

4 Claims, 3 Drawing Sheets

BOLT HOLE MARKER

CROSS REFERENCE TO RELATED APPLICATION

The present application is a conversion utility patent application of prior filed provisional patent application Ser. No. 60/384,459 filed May 31, 2002 and titled "Bolt Hole Marker".

FIELD OF THE INVENTION

The present invention relates to devices and method of marking the locations of drilling holes in the wall plate to receive and pass bolts which have been cast into the floor slab for attachment of the plate to the slab.

BACKGROUND

In construction, such as new construction of homes or outbuildings like garages, sheds and the like, it is the common practice to provide a concrete floor slab. To secure the framing for walls, bolts are set into and cast into the slab when the slab is poured at the perimeter of the slab as dictated by the building plans. Often the bolt pattern is not aligned and the bolt sizes are different as per prevailing building codes, architect's plans or dictates from the structural engineer.

A plate, often a 2×4 or 2×6 or 3×4 or 3×6 piece of lumber defining a plate is secured over the bolts to provide a substrate for attachment of sills, wall framework and the like. Holes are drilled in the plate so that it may be placed over the bolts with the bolts passing through the allotted holes. Nuts are then threaded over the bolts to tie the plate to the slab. Since the bolts may not be aligned and of different sizes, the carpenter must measure each bolt size and measure where to place each hole in the plate to pass the bolt pattern.

One prior art device and method to make the position measurement, is illustrated in FIGS. 1–4. As shown in FIG. 1, there is a poured slab 10 having along and edge thereof a pattern of bolts 12 (only one shown in FIG. 1) which extend inboard of the edge of the slab. The bolts 12 are arranged along a line however during placement and the pouring of the slab 19 may not be aligned along a straight line. Further the bolts 12 may be of different diameters such that the pattern and size of the holes cannot be accurately predicted. Thus it is required to empirically mark and drill holes in the plate 14 so that the plate 14 may be mounted over the bolts 12 and tightened, with nuts, down to the slab 10.

To mark a plate 14 for the drill holes, straight lines 15*a, b* are marked on the slab 10 on either side of the line of bolts 12 using for example a chalk line. The lines 15*a, b* define the projected margins for the plate 14 to span and be passed over the bolts 12. The plate 14 (e.g. a 2×4) is then positioned with one edge along chalk line 15*b*. A marker 16 having a foot 18 and upstanding handle 20 is placed to position a first end 22 of the foot against the bolt 12 as suggested in FIG. 1.

The marker 16, according to the prior art, is shown in FIGS. 2–4. The foot 18 has a first end 22 and a second end 24. At each of the first and second ends 22, 24 there is an arcuate notch 26 to mate with the bolt 12. The foot 18 is generally flat having a length of about 9 inches and has upstanding walls 28 to enable the standing carpenter to use his foot to position the marker 16. Offset and upstanding from the foot 18 is a hollow handle 20. The handle 20 is 3½ inches from the first end 22 and 5 ½ inches from the second end 24. Since the notch 26 receives approximately half the diameter of the bolt 12, the handle 20 would be 3 and 5 inches, respectively, from the center of bolts 12 received in the notches 26. Disposed within the hollow handle 16 for axial movement is a plunger 30 having at one end a grip 32 and at the other end a pointed tip 34 (FIGS. 1 and 4) configured to impart a mark on the plate 14.

To mark the plate 14, the plate 14 is positioned along the chalk line 15*b* adjacent the bolts 12 as shown in FIG. 1. It is assumed in FIG. 1 that the plate is a 2×4. The marker 16 is positioned, with the tip 34 withdrawn into the handle 16, to mate the first end 22 with the bolt 12. In this position the plunger tip 34 is disposed approximately 3 inches from the center of the bolt 12 and aligned with approximately the center of the 2×4 plate 14. Holding the handle 16, the carpenter strikes the grip 32 with a hammer to drive the plunger 30 causing the tip 34 to mark the plate 14. In a similar fashion the carpenter moves down the bolt line marking locations on the plate 14. The carpenter then notes the diameter of the bolts 12 for each mark and drills the holes. The plate 14 is then position over the bolts 12 passing the bolts 12. Nuts (not shown) are threaded over the bolts to secure the plate 14 to the slab 10.

If the plate 14 were a 2×6, the carpenter would use the second end 24 thus positioning the tip 34 to be located near the center of the plate 14.

A drawback of the prior art device described above, is that it can only approximate the position on the plate since it is not adapted to handle a wide variety of bolt sizes. The notches 26 are of the same diameter and thus may not be suitable for bolt sizes ranging from ½ inches to 1¼ inches. For particularly large bolt sizes the prior art marker described above may be inappropriate.

Another drawback is that the carpenter must hold the grip to draw the plunger and tip into the handle thus making one hand operation almost impossible.

There is a need for an improved plate marker which is adapted to overcome the drawbacks noted above.

SUMMARY OF THE INVENTION

There is, therefore, a need for a more precise plate marking device which takes into account different sizes of bolts.

There is a also a need for a marker which can size the bolt for the carpenter to note for the drilling of the holes.

There is a need for a marker which satisfies the foregoing needs which is inexpensive and easy to use, is durable and can be embodied in a hand-held or stand-up version.

There is also a need for a marker which satisfies the foregoing needs which can also accommodate different sizes of plates.

Toward these ends there is set forth a marker for marking a distance from a bolt to a location on a wooden plate which includes a support mounting a marking tip configured to impart a mark by the plate. Rotatably disposed at least at one end of the support is a gauge the gauge having at least two different sized notches to receive and nest two different sized bolts at a predetermined distance from the marking tip. The carpenter or framer positions the gauge to receive the matching sized bolt which positions the tip for marking the plate. A force is imparted to cause the marker to impart a mark on the plate to mark the location for a hole to pass the bolt.

The marker may include pair of spaced marking tips.

In an upstanding embodiment the marker has an upstanding handle mounting a a plunger axially slidable through the handle and having said tip at one end. Further the upstanding embodiment may include a rotatable a gauge at the ends of the support.

BRIEF DESCRIPTION OF THE DRAWINGS

These and other features and advantages will become better appreciated when the same becomes understood with reference to the description, claims and drawings wherein:

DESCRIPTION

Figure 1:
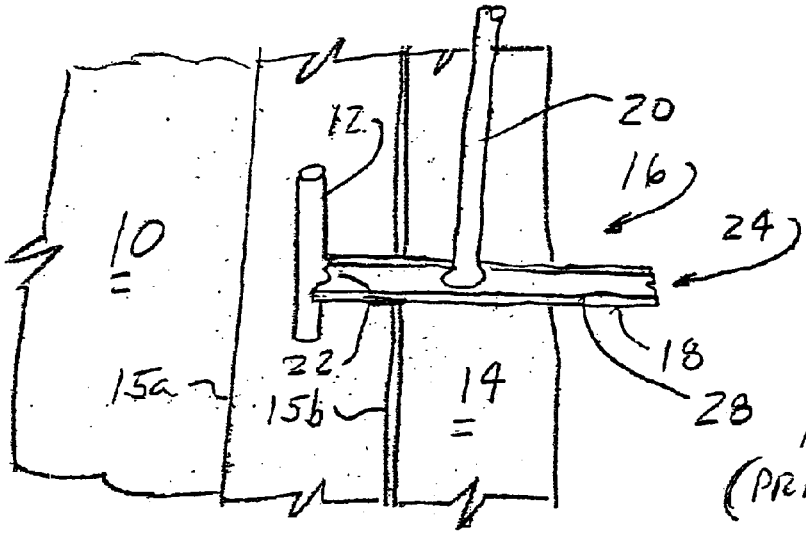
FIG. 1 (PRIOR ART)
FIG. 1 is a side perspective view of the use of a prior art plate marker.
Figure 2:
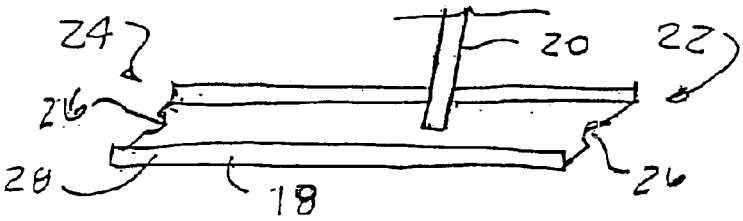
FIG. 2 (PRIOR ART)
FIG. 2 is a side perspective view of the foot of the prior art marker of FIG. 1.
Figure 3:
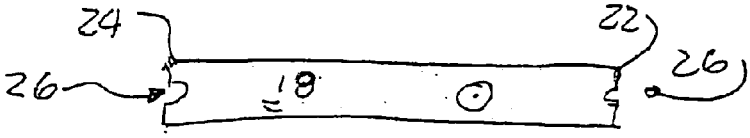
FIG. 3 (PRIOR ART)
FIG. 3 is a bottom view of the prior art marker of FIG. 1.
Figure 4:
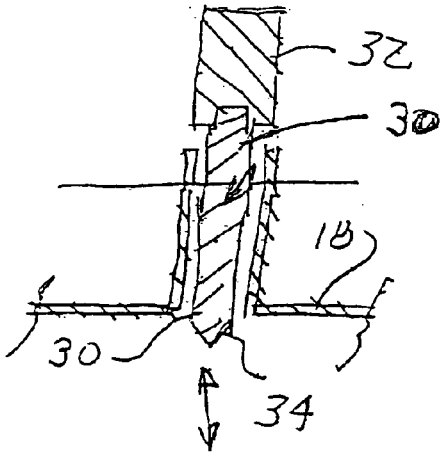
FIG. 4 (PRIOR ART)
FIG. 4 is a side section view of a portion of the prior art marker of FIG. 1.
Figure 5:
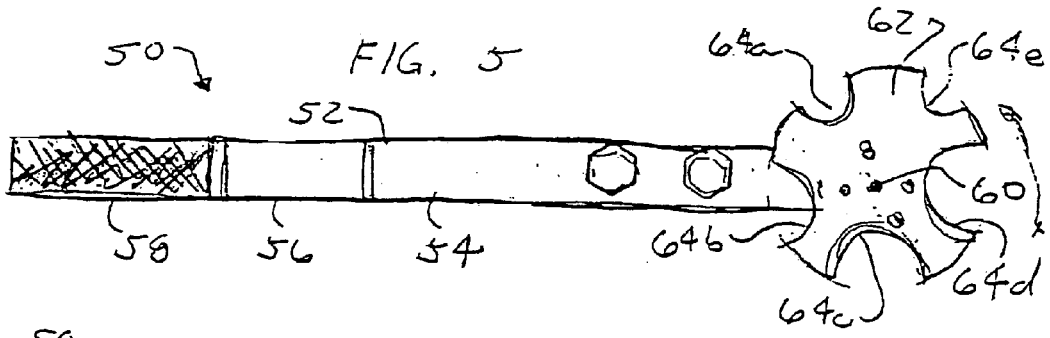
FIG. 5 is a top view of one embodiment of a marker according to the present invention.
Figure 6:
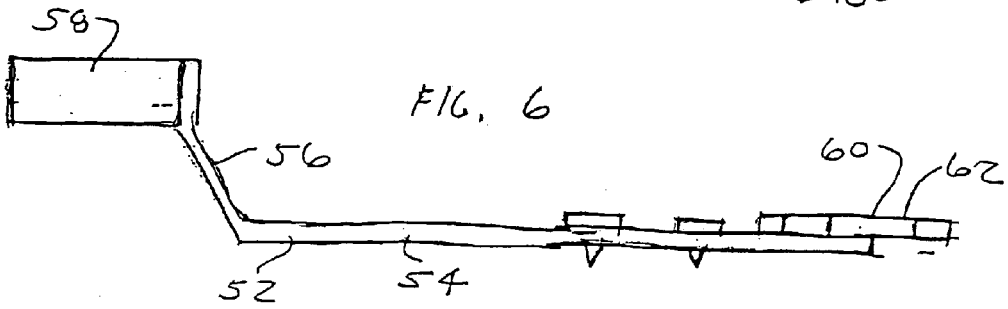
FIG. 6 is a side view of the embodiment of FIG. 5.
Figure 7:
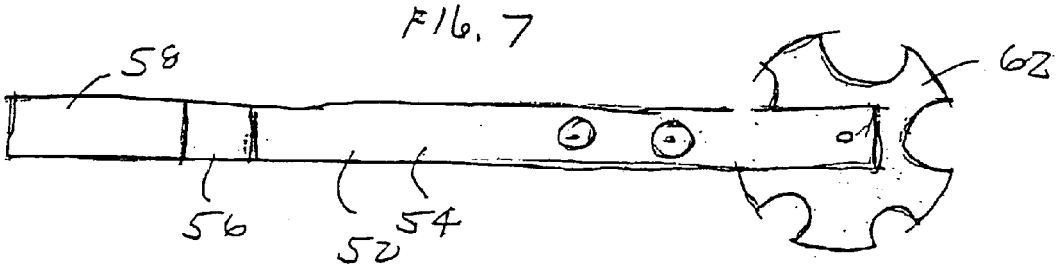
FIG. 7 is a bottom view of the embodiment of FIG. 5.

Turning to FIGS. 5–7 there is shown one embodiment of a plate marker 50 according to the present invention. The marker 50 has a body 52 fashioned from rugged metal or plastic having, in a side view, somewhat of a J-shape to define a flat substrate 54 and an angular arm 56 extending to a handle 58 aligned with the substrate 54 but, in side view, offset therefrom, e.g. above the substrate 54. Opposite the handle 58 there is disposed a pivot 60 pivotally mounting a rotatable, circular, bolt gauge 62.

As suggested in the drawings, the gauge 62 includes a plurality of different sized, semi-circular notches, shown as five notches 64*a–e*, each notch 64*a–e* sized to mate with a different sized bolt. The gauge 62 is fashioned and mounted such the its perimeter is centered about the pivot 60. The notches 64*a–e* may have the following standard sizes (in inches): ½; ⅝, ¾, 1 and 1¼ or could have other or additional sized notches to accommodate, for example, metric sizes. Associated with each notch 64*a–e* may be an inscription as to the bolt size diameter corresponding to the notch 64*a–e*.

To register and align the gauge 62 as adjusted at the end of the substrate, a detent mechanism is provided. Thus the gauge 60 is rotated to locate the desired notch 64*a–e* at the end and at that position the detent mechanism snaps the gauge in correct alignment. To change the notch 64*a–e* the user forcibly rotates the gauge 62 about the pivot 60 to release the detent mechanism.

Unlike markers according to the prior art, the marker 50 and its gauge 60 provide for precise registry with various sizes of bolts so that the center of the bolt 12 is accurately disposed at the end of the marker 50 at a precise distance from a pair of spaced, pointed, tips 66, 68 depending from the underside of the substrate 54. Further the adjustable gauge 62 accommodates different sizes of bolts. Still further, when registered and mated to a bolt 12, the gauge 62 tells the carpenter the correct size of the bolt 12 and hence the size of the hole needed in the plate. The tips 66, 68 depend from the substrate at 3½ and 5½ inches from the perimeter of the gauge 60. Since, when the gauge 60 notches 64*a–e* are registered with the matching sized bolt 12, the center of the bolt 12 is at the perimeter of the gauge 60 and therefore the center of the bolt 12 is 3½ and 5½ inches from the tips 66, 68.

The tips 66, 68 may be fashioned by bolts 70 passing through the substrate 54 and welded thereto. The ends of the bolts 70 are machined to the tips 66, 68.

To use the marker 50, the carpenter positions the gauge 60 to align the proper notch 64*a–e* with the bolt. With the plate 14 aligned on the chalk line, the carpenter puts the marker 50 against the bolt 12 to register it in its matching notch 64*a–e* locating the appropriate tip 64, 66 proximate the center of the plate 14. With a hammer the carpenter strikes the appropriate bolt 70 to drive the appropriate tip 66, 68 into the wooden plate leaving a drill hole mark thereon. The carpenter may also note and write adjacent the mark on the plate the bolt size as indicated by the gauge 60. This procedure is followed for the other bolts 12. After marking the carpenter, at the marked locations, drills the appropriate size hole so that the plate 14 may be passed over the line of bolts 12 and secured thereto.

Figure 8:
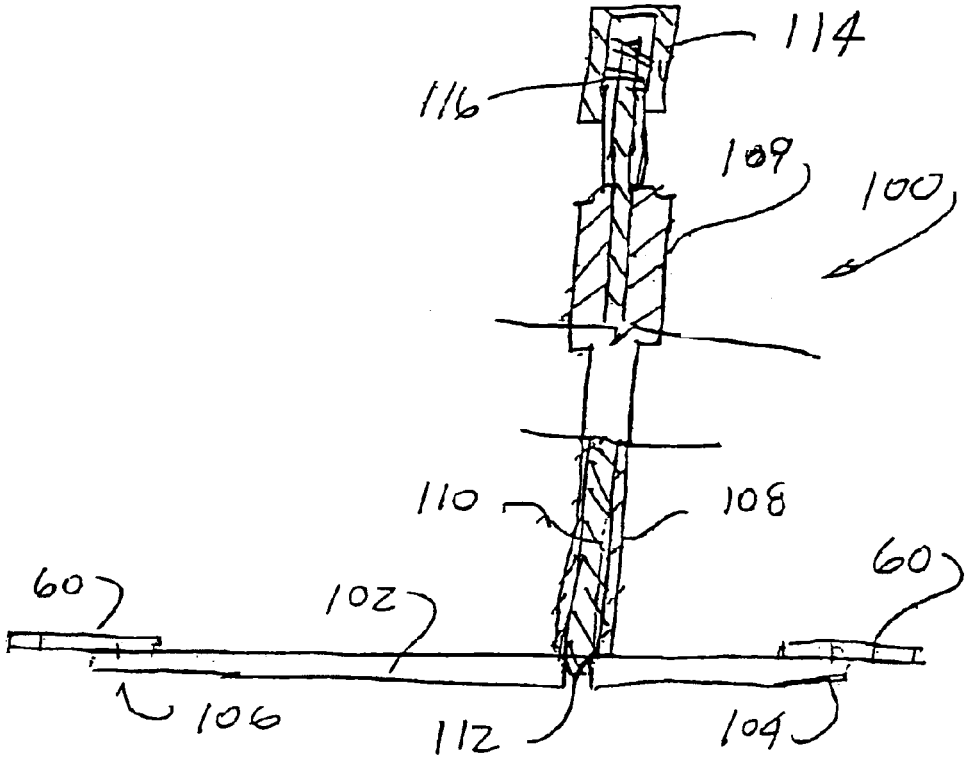
FIG. 8 is a perspective, partial section view of another embodiment of the present invention.

Turning to FIG. 8, there is shown a standing version of the marker of FIGS. 5–7. The marker 100 of FIG. 8 includes a planar foot 102 having rotatably mounted at each end 104, 106 a gauge 60 of the type described above. Located 3½ inches from the distal most perimeter of the gauge 60 at one end 104 and 5½ inches from distal most perimeter of the gauge 60 at the other end 106 is an upstanding, hollow, handle 108. The foot 102 is at one end of the handle 108 and at the other end is a grip 109. Disposed through the length of the handle 108 is a plunger 110 having at one end a tip 112 and at the other end a striking cap 114. Biasing means such as a coil spring 116 disposed between the cap 114 and handle 108 biases the plunger 108 to a position where the tip 112 is withdrawn into the handle 108.

To use the marker 100, the carpenter positions the gauge 60 to match the bolt 12 and positions the foot 102 with the bolt located in the corresponding notch 64*a–e*. Depending on the size of the plate 14, the carpenter will use the appropriate end 104, 106 of the foot. The carpenter then strikes the cap 114 with a hammer to drive the tip into the plate 14 for marking thereof. The carpenter follows the procedure for the other bolts 12. The handle 108 may be of an axial length to permit the carpenter to stand while aligning and striking the cap 114. The carpenter or framer may also note in chalk or pencil the bolt size associated with each mark made with the marker.

I claim:

1. A marker for marking a distance from a bolt to a location on a wooden plate comprising:

(1) a support;

(2) a marking tip configured to impart a mark on the plate and coupled to said support;

(3) the support having a first end and a second end, a rotatable gauge located at the first end of the support and another rotatable gauge located at the second end of the support;

(4) at least one of said rotatable gauges having at least two different sized notches to receive and nest two different sized bolts at a predetermined distance from the tip;

(5) pivot means connected to the support for rotating the at least one rotatable gauge; and (6) an upstanding handle, said upstanding handle and a plunger axially slidable through the handle and having said marking tip at one end.

2. The marker of claim 1 comprising a pair of spaced marking tips.

3. A marker for marking a distance from a bolt to a location on a wooden plate comprising:

(7) a support having a first end and a second end;

(8) a handle to upstand from the support;

(9) a plunger disposed for movement relative to the handle;

(10) a marking tip disposed at an end of said plunger to impart a mark on the plate when a force is imparted to the plunger and for marking a distance from a bolt to a location on a wooden plate;

(11) two rotatable gauges, each one of the rotatable gauges disposed at each end of the support;

(12) at least one of said rotatable gauges having at least two different sized notches to receive and nest two different diameter bolts at a predetermined distance from the tip; and

(13) pivot means connected to the support for rotating the at least one rotatable gauge.

4. The marker of claim 3 comprising said at least one rotatable gauge configured to position the tip on one of 3.5 inches and 5.5 inches from the axis of the bolt when said bolt is positioned in one of the receiving notches of said at least one rotatable gauge.

* * * * *